US005881933A

United States Patent [19]

Rogers

[11] Patent Number: 5,881,933

[45] Date of Patent: Mar. 16, 1999

[54] TRACK MEMBER SYSTEM

[75] Inventor: William H. Rogers, Jacksonville, Fla.

[73] Assignee: Safariland Ltd., Inc., Ontario, Calif.

[21] Appl. No.: 824,910

[22] Filed: Mar. 27, 1997

[51] Int. Cl.[6] ..... A45F 5/00

[52] U.S. Cl. ..... 224/195; 224/665; 224/272; 224/911; 224/901.4; 224/901.8

[58] Field of Search ..... 224/195, 632, 224/271, 272, 904, 665, 666, 269, 911, 901.4, 901.8; 2/94; 211/91.01, 94.02, 162

[56] References Cited

U.S. PATENT DOCUMENTS

| | | | |
|---|---|---|---|
| 312,085 | 2/1885 | Claghorn | 224/904 |
| 775,149 | 11/1904 | Righton | 224/195 |
| 4,797,040 | 1/1989 | Hibbard | 224/272 |
| 5,722,576 | 3/1998 | Rogers | 224/195 |

*Primary Examiner*—Linda J. Sholl
*Attorney, Agent, or Firm*—Arthur G. Yeager

[57] ABSTRACT

A system for carrying containers suspended from a track member which may be attached to a body encircling belt or attached to clothing which includes a pair of protruding tracks substantially parallel and from which the containers for holding articles are suspended by clips on the containers which are attachable to the tracks anywhere along the lengths thereof or positionable lengthwise on the tracks by sliding thereon at tapered ends of the tracks and is particularly useful for police and military personnel in carrying weapons, ammunition and the like holstered articles. This system includes a clamp for locking the container in place on the tracks to prevent the container from sliding along the tracks to an undesired position and inhibiting forceful unintended removal of the clip and container from the tracks without removal of the clamp.

28 Claims, 3 Drawing Sheets

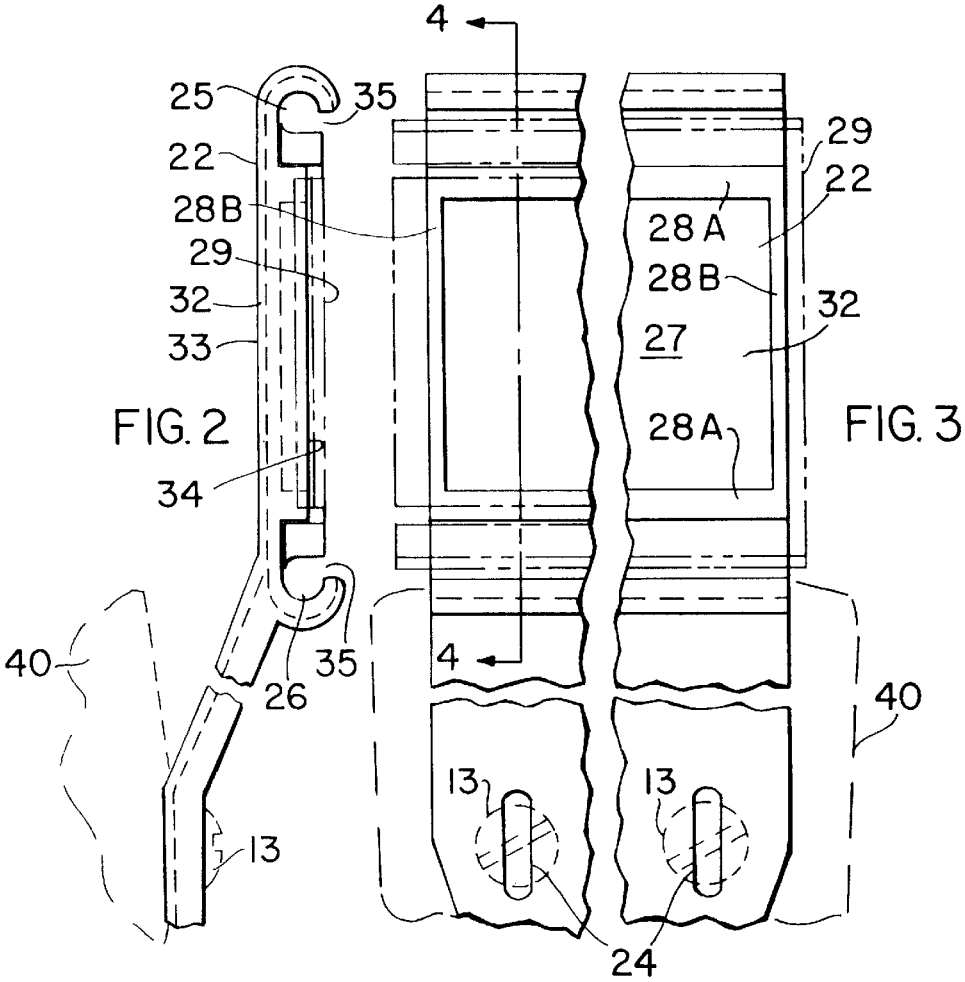
FIG. 2
FIG. 3
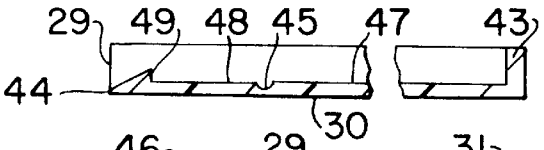
FIG. 7
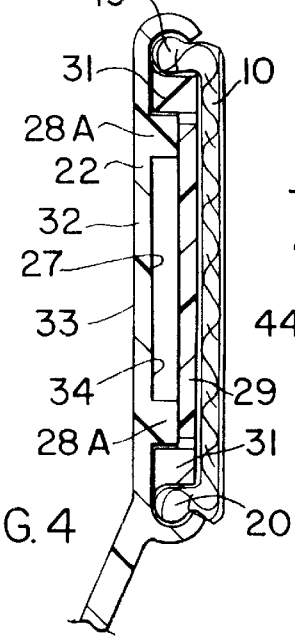
FIG. 4
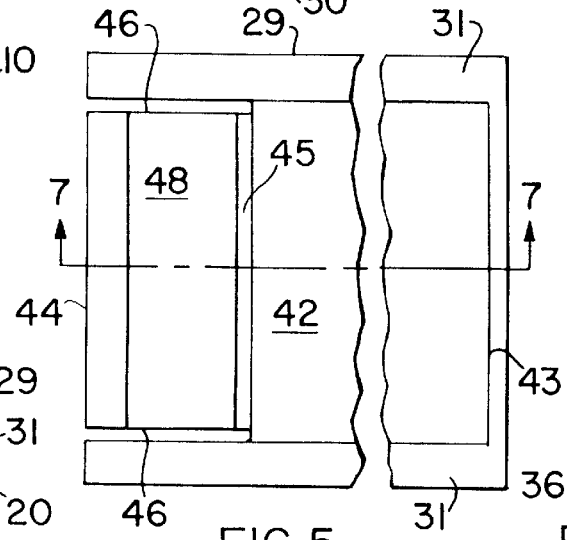
FIG. 5
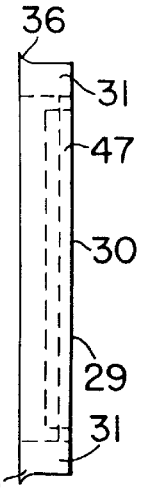
FIG. 6

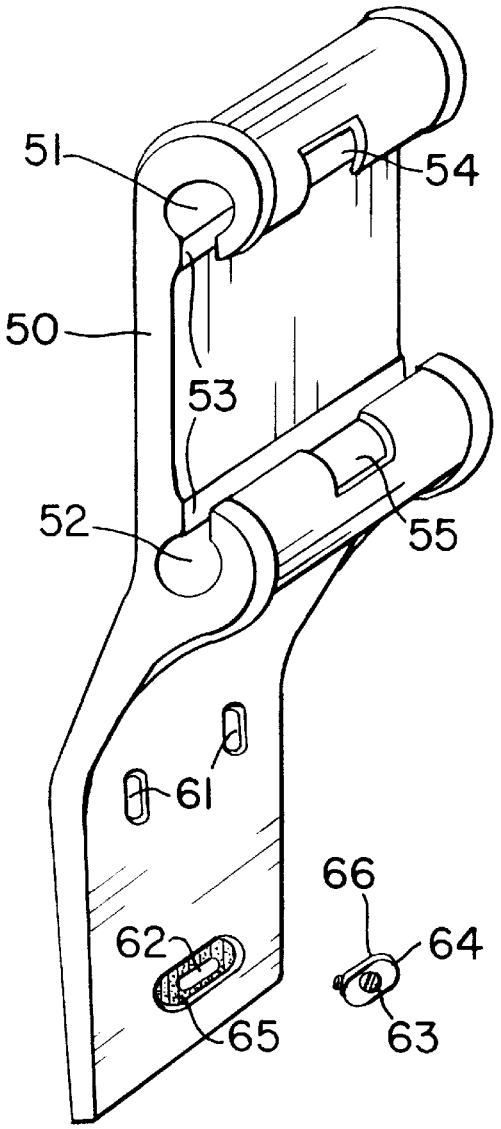
FIG. 8
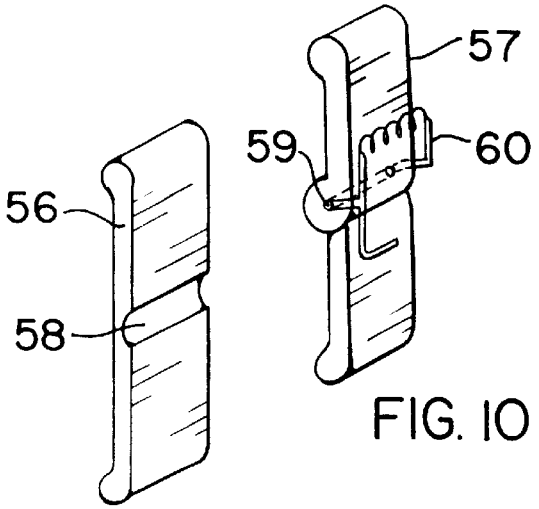
FIG. 10
FIG. 9

TRACK MEMBER SYSTEM

TECHNICAL FIELD

This invention relates to harness systems to be worn by humans for purposes of carrying items of equipment, most particularly, it relates to belts with protruding tracks to which containers can be attached for carrying articles of various types.

BACKGROUND OF THE INVENTION

Police and military personnel have for a long time carried weapons and ammunition attached to a waist encircling belt. In recent years the need for added security has caused a proliferation of safety holsters to protect the wearer from losing his weapon to an attacker. The many designs of safety holsters all require a rigid belt which provides structural integrity and a stable platform from which to draw, and these belts with attaching loops weigh several pounds. A lighter belt system has been needed that would also eliminate the bulky belt loops necessary for each container, i.e., magazine case, holster, handcuff case, radio case, etc.

In my earlier filed U.S. Pat. No. 5,722,576 dated Mar. 3, 1998, a novel, lightweight system for carrying containers by a wearer is described and claimed. That application relates to system to which the many types of containers can be easily attached. Such a track system can, if desired, be incorporated into an armored vest or be used with an extremely lightweight belt and does not require a heavy material separating the tracks. A wide variety of containers can be attached to this track system. It has now been found by modifying the basic features of the track system of U.S. Pat. No. 5,722,576, the system can be further improved, particularly in stabilizing the attached containers against any movement lengthwise along the track. Accordingly, it is an object of this invention to provide an improved system for carrying equipment on the wearer. Also, improvement in permitting attachment of the clip at any desired position is accomplished without threading of the clip onto the tapered ends of the tracks.

SUMMARY OF THE INVENTION

This invention relates to a planar member for carrying a container including a belt having an outside surface facing away from an encircled body and an inside surface facing that body and a track means protruding outwardly from that outside surface and extending lengthwise of the belt. The container is detachably connected to the track means and slidable along that track means by way of a tubular guide having an internal hollow adapted to slide along the track means, and means to prevent unintentional sliding of the container along the tracks of the belt to positions not desired by the wearer.

In preferred embodiments of the invention there are two spaced parallel tracks which are engaged by a clip having two guides attached to the article container. In another preferred embodiment the tracks are fabric covered tubes sewn to opposite edge portions of a central fabric web to form the tracked belt of this invention, and the guides are two space, C-shaped, rigid, smooth surfaced grooves adapted to fit over and slide along the tracks. The belt may be flexed and the grooves positioned on the tracks anywhere along the tracks and the belt becomes unflexed, thus avoiding any need to thread the clip onto the tracks. A wedge type lock may be used to lock the clip in position on this flexed belt or when the clip is threaded onto ends of the tracks.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in consideration with the accompanying drawings in which:

FIG. 2 is an end elevation of an article-carrying container, for example a gun holster, used in this invention for attachment to the track belt;

FIG. 3 is a front plan view of the container shown in FIG. 2;

FIG. 4 is a cross-sectional view taken at 4—4 of FIG. 1;

FIG. 5 is a top plan view of the jamming wedge member shown in FIG. 4;

FIG. 6 is an end elevational view of the jamming wedge member of FIG. 5;

FIG. 7 is a cross-sectional view of the jamming wedge member of FIG. 5;

FIG. 8 is a perspective view of an alternate embodiment of the jamming wedge of this invention, employing a wedge lock member;

FIG. 9 is a perspective view of one embodiment of the wedge lock member of FIG. 8; and FIG. 10 is a perspective view of a second embodiment of the wedge lock member of FIG. 8.

DETAILED DESCRIPTION OF THE INVENTION

Figure 1:
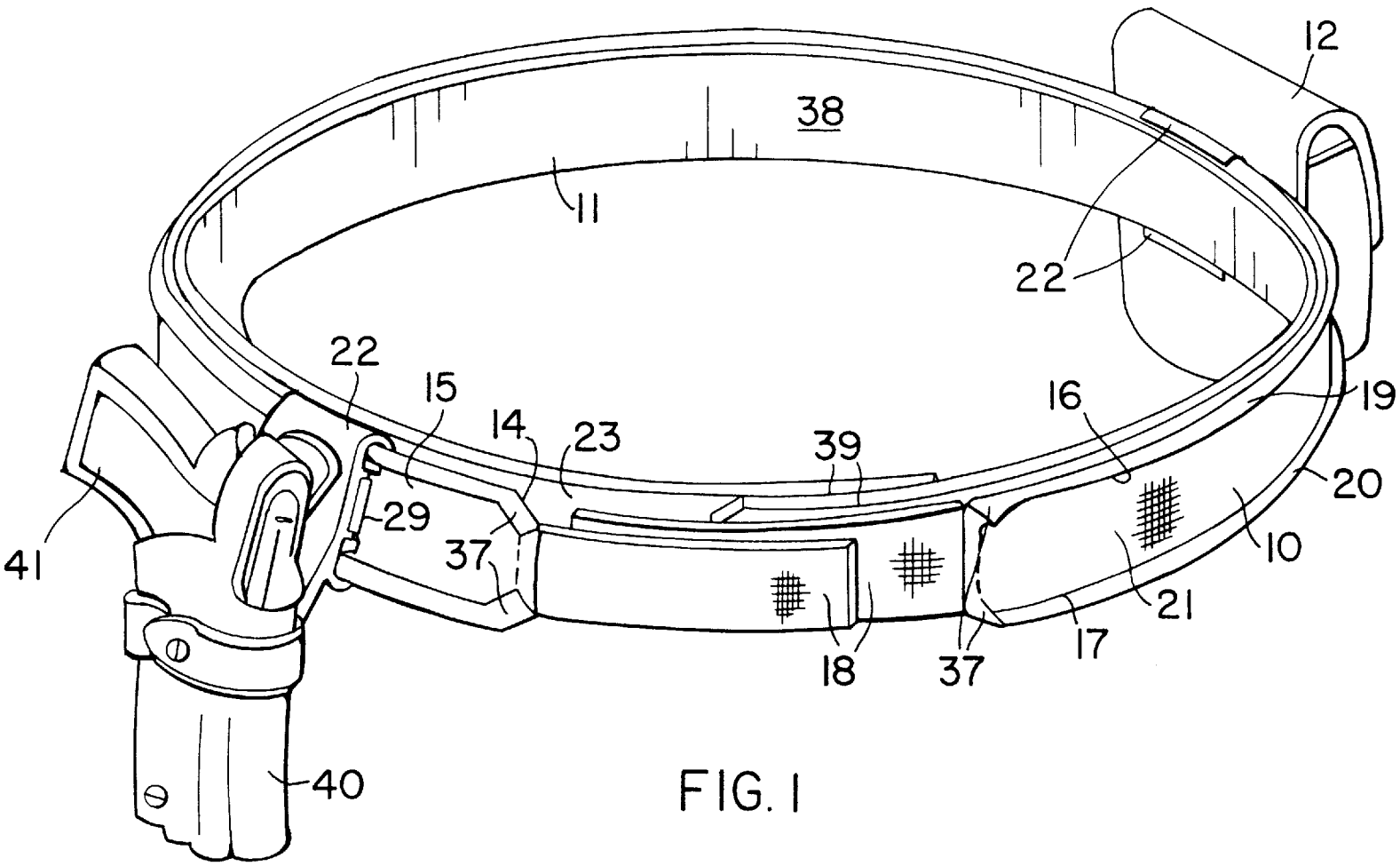
FIG. 1 is a perspective view of the improved track belt system of this invention as it might appear around the waist of a wearer.

This invention relates to an improved belt system as shown in FIG. 1; the general details of which are described in copending application U.S. Pat. No. 5,722,576.

In FIG. 1 the belt components are to be positioned around the waist of a wearer and as viewed by an observer facing the front of the wearer, the body of the wearer being omitted for clarity.

The belt system of this invention is most securely worn when an internal belt 11 is included, although the belt system does not necessarily include internal belt 11. Belt 11 is worn outside the clothing, i.e., outside the trousers, skirt, or jacket of the wearer. Belt 11 has an inside surface 38 and an outside surface 23. Inside surface 38 may be of any texture or type, rough, smooth, leather, fabric, or the like. Outside surface 23 is covered with a layer of fabric loops of the type useful in Velcro fasteners. In order for inside belt 11 to be the most comfortable and useful, the closure belt is accomplished by overlapping ends 39 fitted with cooperating surfaces of fabric loops and fabric hooks so as to eliminate the bulkiness of a buckle. This is not necessary, but is a preferred arrangement. The main purpose for inside belt 11 is to provide a secure surface of fabric loops for attachment of track belt 10 which has hook fabric along its inside surface 14. Track belt 10 is the principal support component of this system. It encircles around belt 11, if one is worn, and has a central body 21 of an elongated narrow web fabric having an upper edge 16 and a lower edge 17, an outside surface 15 and an inside surface 14. Along edge portions 16 and 17, there are track means including upper track 19 and lower track 20 in the form of protruding shoulders each having an enlarged extremity and a reduced neck extending outwardly from the outside surface 15 of the belt body 21. Overlapping ends 18, like ends 39 of belt; 11, are fitted with cooperating portions of fabric loops and fabric hooks in order to provide a secure closure for belt 10. Tracks or guides 19 and 20 extend generally the length of the belt 10 from one overlapping end 18 to the other overlapping end 18. Tracks 13 and 20 are flexible tubular members, preferably covered by a layer of fabric, canvas, nylon or the like, and sewn to central body 21 to produce a single component. The fabric covering tracks or guides 19 and 20 are generally folded neatly to make tapered ends 37 that will provide a smooth transition from the protruding shoulders of 19 and 20 to the smooth flat surface of body 21.

It is, of course, not critical that belt 10 be made of web fabric at 21, and covered by fabric around tracks 19 and 20. Other materials are useful for these purposes, e.g., leather, molded plastic, etc. Buckles may be employed instead of Velcro fabric fasteners for closures of belts 10 and 11, but the preferred is as described above for fabric components, canvas, nylon and the like. As will be seen, tracks 19 and 20 may be of any shape (e.g., T-shape, triangular, etc.) so long as they protrude from the belt 10 and can be attached to containers.

It is to the above basic structure of the track belt 10 that containers or articles may be attached for carrying. These might include a holster 40 for a pistol 41, or a carrier 12 for handcuffs or a first-aid kit, or the like. Holster 40 or carrier 12 are attached to belt 10 by means of clips 22 as generally seen in FIG. 1.

In FIGS. 2–4, there is shown the track belt system of this invention, and more particularly, the combination of the tracked belt 10 and a container 40 attached to a clip 22. Container 40 may be any type of pocket, pouch, holster, or other item for carrying an article. In FIG. 1 the container 40 is a holster for a gun 41 or a pouch 12 for handcuffs (not shown). Other possibilities include a pouch for a first-aid kit, a pocket for ammunition, a holster for a flashlight, a holster for a billy-club, a holster for a radio, etc.

Clip 22 includes a central body plate 32 with an upper tubular guide 25 and a lower tubular guide 26. The inner size of tubular guides 25 and 26 is substantially the same as the outer size of the extremities of tracks 19 and 20, respectively. Generally, both guides 25 and 26 are the same size; and both tracks are the same size, although this is not required. What is necessary is that upper guide 25 and upper track 19 must be compatible; and similarly, lower guide 26 and lower track 20 must be compatible. When tracks 19 and 20 are inserted into guides 25 and 26 the tracks (and the belt body joining those tracks) must be slidable with respect to each other. The sliding is not necessarily loose but may have some frictional impediment. Guides 25 and 26 are tubes having a transverse cross-sectional shape of the letter "C" with opening 35 extending lengthwise of tubular guides 25 and 26 and facing outwardly from body plate 32. Body plate 32 has an outside surface 33 facing away from the body of the wearer and an inside surface 34 facing toward belt 10 and the wearer. Outside surface 33 is preferably planar and inside surface 34 is box-shaped with four upstanding perimeter walls 28A and 28B around a sunken center 27. The outward surfaces of walls 28 all lie in a single plane parallel to surface 33. The lower portion of clip 22 includes a plurality of slots 24 which provide an adjustable attachment means for securing a container, e.g., a holster 40 for a pistol. Screws and T-nuts are frequently used for such an attachment. Broken lines in FIGS. 2 and 3 are intended to show the position of a lock wedge 29 (described below) inserted between inside surface 34 of clip 22 and body 21 of belt 10 to prevent clip 22 from sliding along belt 10. In this way holster 40 and pistol 41 are maintained in place where the wearer selectively installs it.

FIGS. 4–7 show the details of lock wedge 29. As may be seen, particularly in FIGS. 6 and 7, the bottom surface 30 of lock wedge 29 is planar and thereby will slide easily over the continuous surface of body 21 of belt 10. The structure of lock wedge 29 includes parallel side walls 31 perpendicular to end wall 43, all of which are joined to a thin flat base 47 having planar bottom outer surface 30. At the forward end of lock wedge 29 is a knife edge 44 on a flexible tongue 48 which is separated from walls 31 by slits 46 and joined to base 47 by a groove 45 in base 47, providing tongue 48 with a certain amount of flex or hinge action. The forward portion of tongue 48 has a knife edge 44 and an arrow tip ledge 49 for easily sliding under the edges of walls 28B of clip 22 and locking thereto by means of arrow-tip ledge 49 coacting with forward perimeter wall 28B of clip 22. It may be seen in FIG. 4 that the spacing between side walls 31 of lock wedge 29 is coordinated with the outside dimensions of two opposite side walls 28A of clip 22 so as to provide an easy and accurate positioning of lock wedge when it is inserted between belt 10 and clip 22 to lock the latter in place. It is preferable, although not absolutely necessary, to fashion side walls 31 with a feathered edge 36, as shown in FIG. 6, at the end of a rounded contour so as to fit snugly around the corresponding shape of tracks 19 and 20 where said walls and tracks come together. This provides an additional frictional clamping surface as well as completing the guideway to prevent inadvertent removal of the tracks therefrom and to assure the locking of the clip 22 to belt 10.

FIGS. 8–10 illustrate another embodiment for locking a container (carried by a clip 50) to belt 10. In this embodiment clip 50 has a slightly different design from that of clip 22 of FIGS. 2–3. Clip 50 has an upper tubular guide 51 and a lower tubular guide 52 which are parallel to each other and each have a slotted opening 53 such that a transverse cross section of each guide 51 and 52 is similar to the letter "C". The openings 53 in this embodiment face each other which is a different design from those in clip 22 (see FIG. 2). Approximately midway along the length of guides 51 and 52 is a notch 54 in upper guide 51 and a notch 55 in lower guide 52. These notches 54 and 55 are designed to receive the opposite ends of a compatible lock wedge, e.g. 56 and 57 shown in FIGS. 9 and 10. Lock wedge 56 or 57 is bendable, so as to be inserted into notch 54 and 55, and be able to recover from the bend to return to its original position wedging itself in the notch and thereby preventing clip 50 and whatever carrier is attached thereto from sliding lengthwise along belt 10 to some position not desired by the wearer. The wedge of FIG. 9 has a transverse groove which is sufficient to weaken the wedge and allow it to be bent sufficiently to be inserted into notches 54 and 55, and when released, to snap back to its unbent shape jammed into notches 54 and 55 against the track 19 or 20 of belt 10. In FIG. 10 the wedge is actually made in two pieces which fit together about a transverse joint having a hinge pin 59 and a spring 60 to urge the two pieces into an unbent condition. The ends of wedges 56 and 57 are shown to be rounded, but may be of other shapes to provide sufficient frictional pressure needed to prevent lateral sliding of clip 50 along belt 10. Of course, the design of the edges of notches 54 and 55 must be coordinated with the design of the ends of wedges 56 and 57.

Another feature is shown in FIG. 8 that is also applicable to the clip of FIGS. 2 and 3. As mentioned above, the clip 22 or 50 is attached to a carrier, e.g., a holster, by two or three screws and T-nuts. In FIG. 8 there are two upper slots 61 and one lower slot 62. Lower slot 62 is fashioned with a countersunk elongated oval surface that has vertical sawtooth ridges or otherwise is roughened to provide a highly frictional surface. Screw 63 is fitted with a washer 64 having a sawtooth ridged or otherwise roughened surface to mate with similarly roughened countersunk surface 65. Generally the length of countersunk surface 65 is about twice as long as the length of washer 64 so as to permit adjustment to suit the wearer. Preferably the long axis of countersunk surface 65 is parallel to the length of guides 51 and 52 so as to permit a holster attached to clip 50 to be adjusted by tilting it as preferred by the wearer. Upper slots 61 may also be prepared with countersunk ridged surfaces and washers to provide vertical adjustment of the holster, although normally sufficient adjustment is provided by employing this design only on the one lower slot 62.

Among the advantages of this track belt system over prior art systems is that this system is comfortable and will stand much wear and tear; it is flexible and lightweight; the tracks or guides 19 and 20 are hollow tubes having great strength and toughness; the belt can be made with some play in the spacing between tracks and thus permitting errors in alignment to be usable; and tapered ends 36 on the guides 25 and 26 can be incorporated to make insertion of tracks 19 and 20 easier, and buckles may be added to belt 10 to dress up the system as desired. Also, the belt being semiflexible permits temporary flexing of the tracks toward each other and positioning the tracks adjacent the guideways and when released the tracks snap into the guideways and then lock thereto to prevent relative movement therebetween.

It should be noted that a two-track belt system is shown in the drawings, and described above, and at least two tracks are preferred for the intended purposes described herein.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A tracked member for a wearer for carrying a container comprising an elongated planar member having an outside surface facing away from a wearer's body and an inside surface facing toward the body, an elongated track means protruding outwardly from said outside surface and extending lengthwise of said member, a container being detachably secured to said track means and being positionable along said track means, said container having an inside surface adjacent said outside surface of said member, said container including an elongated tubular guide means having an internal hollow complemental to said track means and being positioned lengthwise along said track means; a planar wedge element being manually insertable between said planar member and said container to clamp said container to said track means to fix its position relative to said track means.

2. The tracked member of claim 1 wherein said wedge element includes a bendable tongue having a transverse ledge adapted to freely pass over a wall edge on said container as said wedge element is inserted between said planar member and said container, and to catch on said wall edge when said wedge element is moved in a withdrawal direction.

3. The tracked member of claim 1 wherein said wedge element includes a knife edge positioned between said track means and said tubular guide means along the length of said wedge element.

4. The tracked member of claim 1 wherein said planar member has opposite end portions, said tracked member further including a closure means of cooperating fabric hooks and fabric loops on respective said end portions of said planar member.

5. The tracked member of claim 1 wherein said container is a handgun holster.

6. The tracked member of claim 5 wherein said planar member is a belt adapted to encircle the waist of a wearer's body, with said track means exposed outwardly therefrom.

7. The tracked member of claim 6 further comprising an inner planar belt having an outside surface adjacent said inside surface of said planar member, said inner belt having fabric loops substantially along said outside surface, said planar member having a layer of fabric hooks on said inside surface, said tracked member being detachably connected to said inner belt by said fabric loops and fabric hooks.

8. A tracked member for a wearer for carrying a container comprising an elongated semiflexible planar member having an outside surface facing away from a wearer's body and an inside surface facing toward the body, a pair of elongated spaced parallel tracks protruding outwardly from said outside surface and extending lengthwise of said member, each of said tracks having an enlarged extremity with a reduced neck, a container being detachably secured to said tracks and being positionable along said tracks, said container having an inside surface adjacent said outside surface of said member, said container including a pair of elongated spaced parallel tubular guides having an internal hollow complemental to said tracks, said container being positionable lengthwise along said tracks, said tubular guides having facing entranceways for receiving respective said enlarged extremities of said tracks through respective said entranceways for seating of said tracks in respective said guides.

9. The tracked member of claim 8 further comprising selective means for sufficiently filling said entranceways to inhibit removal of said tracks from said guides.

10. The tracked member of claim 8 wherein said planar member is manually bendable generally along its elongated axis for temporarily moving said tracks toward each other to be inserted into respective said entranceways and then released to be seated in respective said guides.

11. In a tracked member for a human to wear for carrying a container comprising an elongated planar member having an outside surface facing away from a wearer's body and an inside surface facing toward the body, a pair of elongated parallel, spaced track means protruding outwardly from said outside surface and extending lengthwise of said member, said container being detachably secured to said track means and being positionable along said track means, said container having an inside surface adjacent said outside surface of said member, said container including a pair of elongated parallel, spaced tubular guide means having internal hollows complemental to said track means; the improvement which comprises a jamming member insertable between said member and said container to eliminate any relative movement between said member and said container in a direction parallel to said track means.

12. The tracked member of claim 11 wherein said track means has a circular cross-section.

13. The tracked member of claim 11 wherein said planar member includes an elongated narrow strip of fabric having two spaced elongated edges, said track means including a pair of spaced parallel elongated tubular members positioned respectively along said elongated edges of said strip of fabric, said tubular members and said narrow strip all being covered by a smooth tough layer of fabric sewn into and forming a single unitary tracked member.

14. The tracked member of claim 13 wherein each said tubular member is shorter in length than said strip of fabric, and wherein a tapered connection is formed by said narrow strip to join an end of said tubular member with said outside surface of said strip of fabric.

15. The tracked member of claim 11 wherein each of said tubular guide means includes a rigid elongated guide rail having a cross-section in the shape of the letter C, with the opening into the interior of said letter C being smaller than the thickness of said track to inhibit escape of said track from said guide rail, said guide rail having a lengthwise entrance to receive said track means slidingly therethrough.

16. A tracked belt for carrying a container detachably secured thereto, comprising an elongated narrow belt adapted to encircle a body part and including an upper and a lower edge portion, an inside surface facing said body part, an outside surface facing away from the body part and two ends adapted to be releasably attached to each other, said upper and lower edge portions each carrying an elongated tubular member extending generally the length of said belt forming an upper shoulder guide and a lower shoulder guide substantially parallel with each other and protruding outwardly from said outside surface, said tubular members being separated by and attached to a central flat semiflexible body, said container having firmly attached thereto a smooth inflexible clip having a guideway for each said shoulder guide of said belt, said guideway having a cross-section with an internal area substantially the same in size and shape to said shoulder guide and having a lengthwise slit to permit said guideways to be positioned onto said guide shoulders; and a flat semiflexible wedge member insertable between said outside surface of said belt and said central flat semiflexible body of said container; said wedge including a pair of spaced ledges to cooperate with ledges on said central flat semiflexible body to prevent unintentional movement of said wedge and said container, lengthwise of said belt.

17. The tracked belt of claim 16 further comprising an inner belt worn between the body part and said inside surface, said inner belt including an outside surface having fabric loops thereon, said tracked belt having fabric hooks on said inside surface for detachably connecting said fabric hooks to said fabric loops.

18. The tracked belt of claim 16 wherein said container is a handgun holster.

19. The tracked belt of claim 16 wherein said guideways have smooth and tapered entrance ends.

20. The tracked belt of claim 16 wherein each said tubular member is a hollow cylindrical tube.

21. A tracked belt for carrying a container detachably secured thereto, comprising an elongated narrow belt adapted to encircle a body part and including an upper and a lower edge portion, an inside surface facing a body part, an outside surface facing away from a body part and two ends adapted to be releasably attached to each other, said upper and lower edge portions each carrying an elongated tubular member extending generally the length of said belt forming an upper shoulder guide and a lower shoulder guide substantially parallel with each other and protruding outwardly from said outside surface, said tubular members being separated by and attached to a central flat semiflexible body, said container having firmly attached thereto a smooth inflexible clip having a guideway for each said shoulder guide of said belt, said guideway having a cross-section with an internal area substantially the same in size and shape to said shoulder guide and having a lengthwise slit to permit said guideways to be positioned onto said guide shoulders, and means to selectively lock said clip to said tubular members to fix a position of said container on said belt.

22. The tracked belt of claim 21 wherein said guideways have smooth and tapered entrance ends.

23. The tracked belt of claim 21 wherein said guideways each include a notch substantially midway of the length thereof, said notches being formed to receive opposite ends of a semiflexible lock wedge forming said means to selectively lock which when inserted into said notches presses against said tubular members and prevents sliding longitudinal movement of said tubular members with respect to said tubular guideways.

24. The tracked belt of claim 23 wherein said lock wedge is a generally rectangular element adapted to be bent by manual pressure about a central transverse axis and upon release of the manual pressure to snap back to the original unbent position.

25. The tracked belt of claim 24 wherein said lock wedge includes a pair of spaced ends generally parallel to a groove midway between said ends.

26. The tracked belt of claim 24 wherein said lock wedge is generally rectangular with a pair of spaced ends, said lock wedge including a hinge axis generally parallel to said ends, and spring means urging said lock wedge to remain in a generally planar position.

27. The tracked belt of claim 21 wherein said means to selectively lock includes a jamming member including a generally rectangular element adapted to slide lengthwise of said belt between said tubular members and having sufficient thickness to provide a snug fitting between said belt and said container, said jamming member preventing relative lengthwise movement therebetween.

28. The tracked belt of claim 27 wherein said jamming member includes a flexible tongue with a transverse ledge on said jamming member to cooperate with a transverse bar on said container.

* * * * *